US006994631B1

(12) United States Patent
Habing

(10) Patent No.: US 6,994,631 B1
(45) Date of Patent: Feb. 7, 2006

(54) SWING

(75) Inventor: Ted Habing, Santa Ana, CA (US)

(73) Assignee: Dream Visions, LLC, Santa Ana, CA (US)

( * ) Notice: Subject to any disclaimer, the term of this patent is extended or adjusted under 35 U.S.C. 154(b) by 0 days.

(21) Appl. No.: 10/357,598

(22) Filed: Feb. 3, 2003

(51) Int. Cl.
*A63G 9/12* (2006.01)

(52) U.S. Cl. ..... 472/125; 297/245

(58) Field of Classification Search ..... 472/118–125; 297/77, 245, 247
See application file for complete search history.

(56) References Cited

U.S. PATENT DOCUMENTS 383,553 A 5/1888 Bettes
654,779 A 7/1900 Bowland
868,640 A * 10/1907 Buch ..... 297/278
1,156,189 A * 10/1915 Stohler ..... 297/245
1,264,172 A 4/1918 Fritz
1,714,247 A 5/1929 Smedley
3,044,774 A * 7/1962 Hannas ..... 472/125
3,447,802 A * 6/1969 Grudoski ..... 472/120
3,825,299 A * 7/1974 Gaucher ..... 297/157.1
4,256,300 A * 3/1981 Boucher ..... 472/118
5,154,672 A * 10/1992 Brown ..... 472/118
6,027,409 A * 2/2000 Favorito et al. ..... 472/118
6,547,328 B2 * 4/2003 Liu ..... 297/245

* cited by examiner

*Primary Examiner*—Kien Nguyen
(74) *Attorney, Agent, or Firm*—Blakely, Sokoloff, Taylor and Zafman

(57) ABSTRACT

A swing has a fixed support structure and a rigid subframe suspended therefrom. The subframe is suspended on a single pivot axis, thereby permitting pendular motion below the support structure. Seats are mounted on the subframe to provide side-by-side and/or face-to-face seating. The subframe is configured to arc around behind the seats rather than intrude into the space between the seats.

25 Claims, 3 Drawing Sheets

SWING

BACKGROUND OF THE INVENTION

1. Field of the Invention

The present invention generally comprises a swing set. More particularly, the invention relates to a pendular motion swing for plural occupants.

2. Background

Swings have long been a popular play apparatus for children. Certain types of swings, such as porch swings, are also enjoyed by adults. Various types of porch and garden swings are known in the prior art. Most such swings are suspended from an overhead structure by chains or the like. Others, often referred to as "gliders", are suspended from a support structure by multiple pivoting links. These types of prior art swings do not provide a true pendular motion, which is particularly relaxing. While some pendular motion swings are known in the prior art, their designs make entry and exit awkward and they are difficult to propel.

SUMMARY OF THE INVENTION

The present invention provides a swing comprising a fixed support structure and a rigid subframe suspended therefrom. The subframe is suspended on a single pivot axis, thereby permitting pendular motion below the support structure. Seats are mounted on the subframe to provide side-by-side and/or face-to-face seating. The subframe is configured to arc around behind the seats rather than intrude into the space between the seats.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
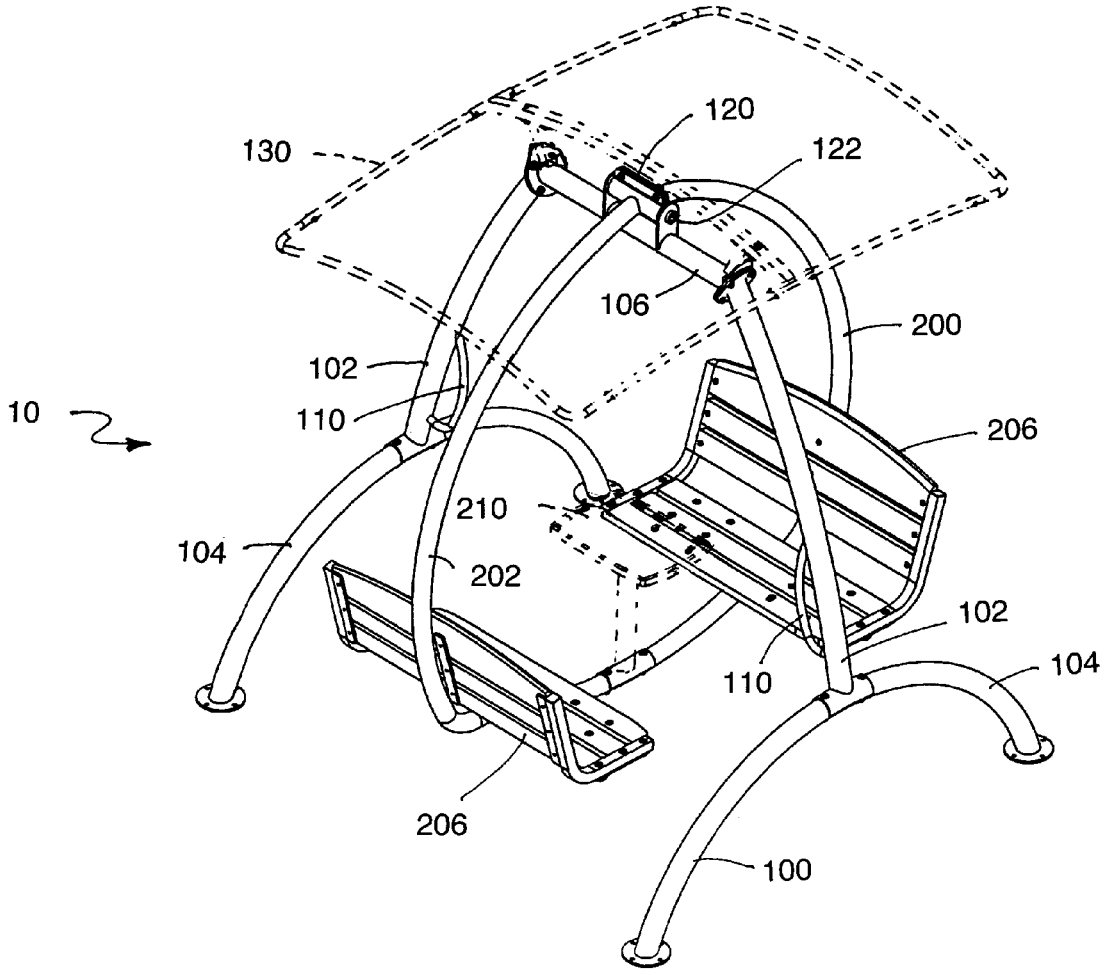
FIG. 1 is a perspective view of a first embodiment of a swing according to the present invention.

FIG. 1 is a perspective view of a swing 10 with seating for up to four persons. Swing 10 comprises a stationary support structure 100 and a movable subframe 200. Subframe 200 is suspended from support frame 100 by means of pivot assembly 120. Support structure 100 comprises a pair of uprights 102 attached to stabilizing legs 104. The uprights 102 are joined together at their upper ends by transverse beam 106. Legs 104 provide a stabilizing base for swing 10. The legs may comprise arcuate numbers as shown or may be bent into a shape of straight segments. The legs may also comprise straight horizontal members that rest on the supporting surface.

Subframe 200 comprises a member 202 bent into a generally ovoid shape. A bearing 204 is disposed at the top of the subframe and is carried by pivot assembly 120. Seats 206 are mounted on the subframe. As shown here, a pair of seats are mounted in a facing relationship. Seats 206 may be individual seats or may each be wide enough to accommodate two persons. It should be observed that the structural member 202 of subframe 200 does not encroach within the seating area. The seats are mounted such that member 202 is disposed entirely behind and entirely below the seats in the proximity thereof. The absence of structural members intruding into the seating area makes access to the seats easier and contributes to a more pleasant recreational experience. Ingress and egress are further assisted by handles 110 mounted on support uprights 102.

Seats 206 are disposed on subframe 200 so that the occupants can rest their feet on the ground when the swing is stationary. This provides a more comfortable seating position when the occupants desire to remain stationary. Furthermore, such a seating position allows the swing to be easily propelled by use of the occupants' feet since their feet can remain on the ground while swinging. This is important since a rigidly suspended pendular motion swing can not be easily put into motion with the "pumping" action commonly used to propel a chain-suspended swing.

Support structure 100 and subframe 200 are preferably constructed of steel tubing for strength, durability and economy. However, other materials, such as aluminum or fiberglass, may be used if desired. Seats 206 may be constructed as wooden benches or may be molded with a suitable plastic material. Seats 206 may be either cushioned or uncushioned.

A table 210 may be provided as an optional feature. Table 210 may be mounted to subframe member 202 with an appropriate fitting so that it can be easily removed by the user, if desired. A canopy frame 130 may also be included as an optional feature.

Figure 2:
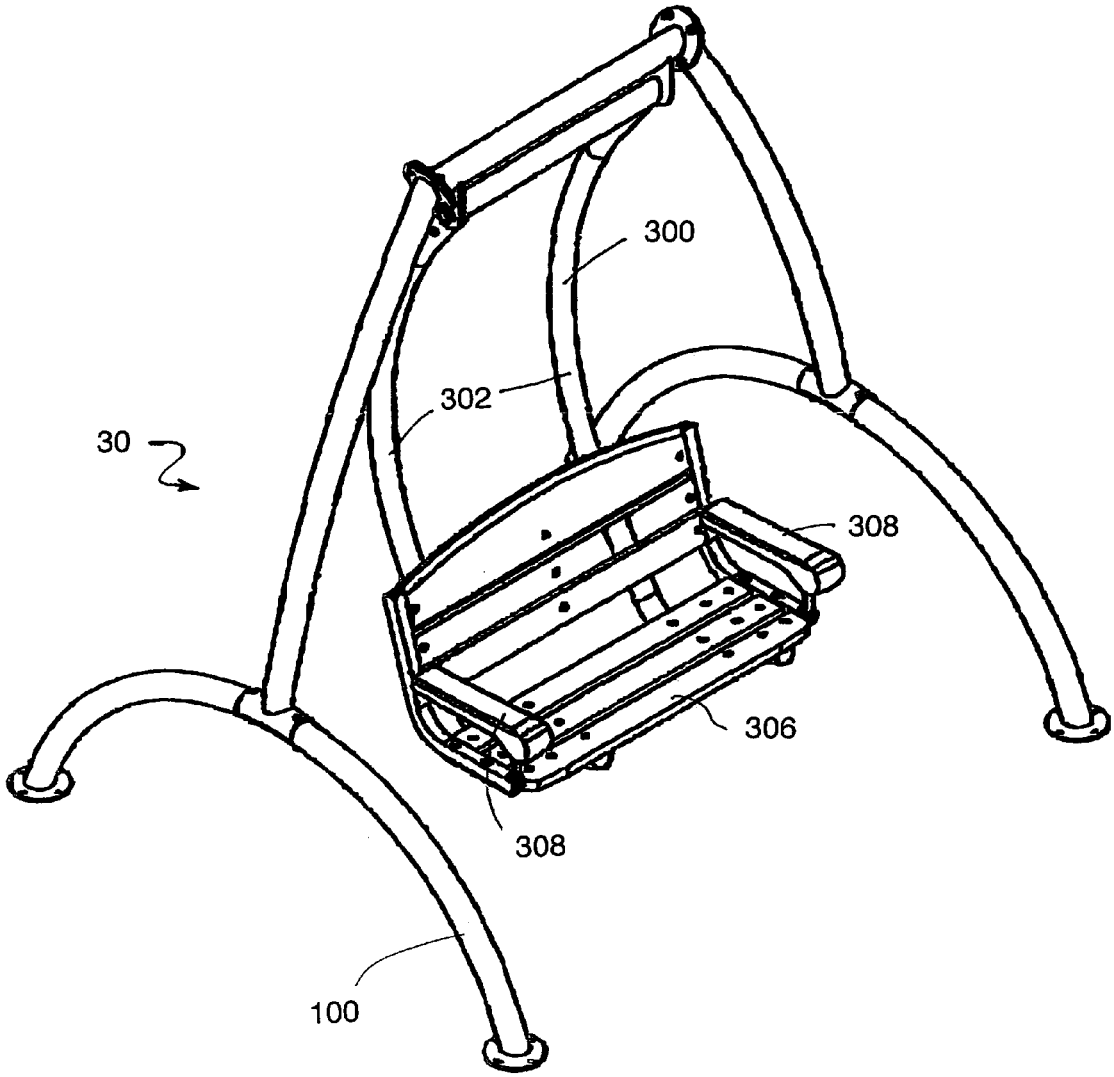
FIG. 2 is a perspective view of a second embodiment of a swing according to the present invention.

Another embodiment of a swing constructed in accordance with the present invention is illustrated in FIG. 2. Swing 30 is substantially similar to the previously described swing 10. In this case, however, only a single seat 306 is provided. Subframe 300 comprises an arcuate member 302, which is essentially one half of the subframe member 202 in the previously described embodiment. Indeed, subframe member 302 may be designed so that two of them may be joined to a lower center section (not shown) to provide a closed loop subframe 202.

Figure 3:
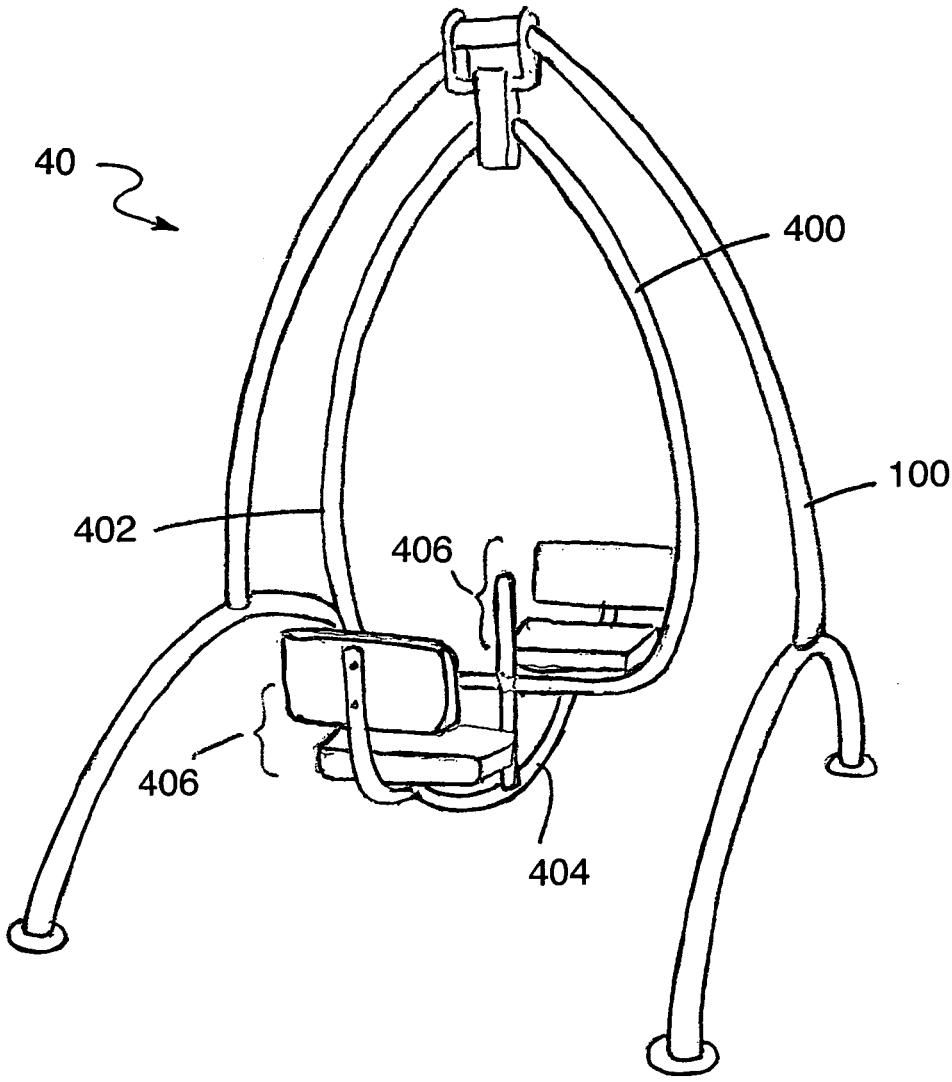
FIG. 3 is a perspective view of a third embodiment of a swing according to the present invention.

Yet another embodiment of a swing constructed in accordance with the present invention is illustrated in FIG. 3. Swing 40 differs from the previously described embodiments in that subframe 400 is oriented transversely rather than longitudinally. The support structure is identical to that previously described. Subframe 400 comprises a primary subframe 402 in the shape of a loop and a secondary, longitudinal subframe 404 that supports seats 406.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A swing comprising:

a fixed support structure;

a rigid subframe suspended from the support structure on a single transverse pivot axis;

first and second seats in a facing relationship, each of the first and second seats having a back side and a bottom side and wherein the subframe proximate to each of the first and second seats is disposed entirely behind the back side of the respective seat;

wherein the subframe is arranged to support the first and second seats for pendular motion about the single transverse pivot axis.

2. The swing of claim 1 wherein the subframe proximate to each of the first and second seats is disposed entirely below the bottom side of the respective seat.

3. The swing of claim 1 wherein each of the first and second seats accommodates two persons.

4. The swing of claim 1 further comprising a table disposed between the first and second seats.

5. The swing of claim 1 wherein the subframe comprises a single closed loop perpendicular to the pivot axis.

6. The swing of claim 1 wherein the support structure comprises first and second uprights disposed on opposite sides of the subframe.

7. The swing of claim 6 wherein the support structure further comprises a transverse beam supporting a pivot assembly.

8. The swing of claim 6 wherein the support structure further comprises first and second stabilizing legs coupled to respective ones of the first and second uprights.

9. The swing of claim 8 wherein the first and second stabilizing legs each comprise an arcuate member concave to a supporting surface.

10. A swing comprising:

a fixed support structure supporting the swing above a supporting surface, the support structure having first and second transversely disposed uprights and a transverse beam coupled to respective top ends of the first and second uprights;

a rigid subframe suspended from the transverse beam on a single transverse pivot axis, the subframe lying within a single longitudinal plane;

at least one seat attached to the subframe, the seat having a back side and a bottom side, wherein the support structure and the subframe are dimensioned such that an occupant of the seat is able to rest the occupant's feet on the supporting surface when the swing is stationary;

wherein the subframe is arranged to support the at least one seat for pendular motion about the single transverse pivot axis.

11. The swing of claim 10 wherein the subframe proximate to the seat is disposed entirely below the bottom side of the seat.

12. The swing of claim 10 comprising first and second seats in a facing relationship and wherein the subframe proximate to each of the first and second seats is disposed entirely behind the back side of the respective seat.

13. The swing of claim 12 wherein the subframe proximate to each of the first and second seats is disposed entirely below the bottom side of the respective seat.

14. The swing of claim 12 wherein each of the first and second seats accommodates two persons.

15. The swing of claim 12 further comprising a table disposed between the first and second seats.

16. The swing of claim 12 wherein the subframe comprises a single closed loop perpendicular to the pivot axis.

17. A swing comprising:

a fixed support structure supporting the swing on a supporting surface;

a rigid subframe suspended from the support structure on a single transverse pivot axis;

first and second seats attached to the subframe in a facing relationship, each of the first and second seats disposed so that a human occupant thereof can rest the occupant's feet on the supporting surface when the swing is stationary;

wherein the subframe is arranged to support the first and second seats for pendular motion about the single transverse pivot axis.

18. The swing of claim 17 wherein each of the first and second seats accommodates two persons.

19. The swing of claim 17 further comprising a table disposed between the first and second seats.

20. The swing of claim 17 wherein the subframe comprises a single closed loop perpendicular to the pivot axis.

21. The swing of claim 17 wherein the subframe comprises a rigid primary subframe suspended from the transverse beam and lying within a single transverse plane.

22. The swing of claim 17 wherein the support structure comprises first and second uprights disposed on opposite sides of the subframe.

23. The swing of claim 22 wherein the support structure further comprises a transverse beam joining upper ends of the first and second uprights.

24. The swing of claim 23 wherein the support structure further comprises first and second stabilizing legs coupled to respective ones of the first and second uprights.

25. The swing of claim 24 wherein the first and second uprights arc inwardly from the stabilizing legs to the transverse beam.

* * * * *